US005906244A

United States Patent [19]

Thompson et al.

[11] Patent Number: 5,906,244

[45] Date of Patent: May 25, 1999

[54] ROTARY IMPACT TOOL WITH INVOLUTE PROFILE HAMMER

[75] Inventors: Scott C. Thompson, Athens, Pa.; Timothy R. Cooper, Titusville, N.J.

[73] Assignee: Ingersoll-Rand Company, Woodcliff Lake, N.J.

[21] Appl. No.: 08/942,625

[22] Filed: Oct. 2, 1997

[51] Int. Cl.[6] ..... B25D 15/00

[52] U.S. Cl. ..... 173/93.5

[58] Field of Search ..... 173/93, 93.5, 93.6, 173/178, 109

[56] References Cited

U.S. PATENT DOCUMENTS

| | | | |
|---|---|---|---|
| 2,285,638 | 6/1942 | Amtsberg . | |
| 2,580,631 | 1/1952 | Whitledge | 173/93.5 |
| 2,802,556 | 8/1957 | Schmid | 173/93.5 |
| 3,072,232 | 1/1963 | Martin et al. | 173/93.5 |
| 3,321,043 | 5/1967 | Vaughn | 173/93.5 |
| 3,533,479 | 10/1970 | Madsen et al. | 173/93.5 |
| 3,552,499 | 1/1971 | Maurer | 173/93.5 |
| 3,661,217 | 5/1972 | Maurer | 173/93.5 |
| 4,487,272 | 12/1984 | Bleicher et al. | 173/109 |
| 5,595,251 | 1/1997 | Cook, Jr. | 173/178 |
| 5,738,177 | 4/1998 | Schell et al. | 173/178 |

OTHER PUBLICATIONS

"Ingersoll–Rand Impactools"—Marketing Brochure, Authored by various Ingersoll–Rand employees, Pertinent pp. 2–3, Published 1996.

*Primary Examiner*—Scott A. Smith
*Attorney, Agent, or Firm*—Donald W. Walk; Leon Nigohosian, Jr.

[57] ABSTRACT

The invention is an improved rotary impact tool that uses a motor driven mechanism well known in the art as the Maurer mechanism comprising a hammer anvil frame and pins to cause impact loads applied through a rotary output shaft. The improvement is an improved striking surface geometry formed on the impact delivering jaw surface forming an involute profile generated from a base circle having an axis that is parallel to the axis of rotation of the output shaft.

5 Claims, 6 Drawing Sheets

ROTARY IMPACT TOOL WITH INVOLUTE PROFILE HAMMER

BACKGROUND OF THE INVENTION

This invention relates to a rotary impact power tool that delivers in rapid succession a series of rotary impact forces or blows. Tools of this type are typically used to tighten or loosen high torque nuts or bolts or similar items.

A conventional rotary impact wrench mechanism, known as a "swinging weight" mechanism, is disclosed in U.S. Pat. No. 2,285,638, issued to L. A. Amtsberg. While this mechanism was rather inefficient, it was one of the first to deliver rotary force in a series of impact blows. The ability to deliver a series of impact blows offers a human operator a tremendous advantage in that the operator can physically hold the impact wrench while delivering very high torque forces in very short bursts or impacts. The advantage of applying short duration high torque impact blows is that a normal human being can continue to physically hold the tool while applying very high torque forces. If the torque were applied continuously, it would result in an opposite continuous reaction force on the tool that would be far too great to be held by a normal human being.

The "swinging weight" mechanism was greatly improved upon by the invention of Spencer B. Maurer as disclosed in U.S. Pat. No. 3,661,217, which is hereby incorporated by reference. This patent describes a swinging weight impact wrench mechanism with a hammer member that is substantially free of tensional stresses during impact. The Maurer "swinging weight" mechanism has a swinging hammer pivoted on a novel type pivot with a center of mass of the hammer near the center of rotation of the mechanism. This enables the swinging weight mechanism to strike a more balanced blow to an anvil and, ultimately, to the output shaft to tighten or loosen bolts, for example.

The problem with the Maurer mechanism is that the curved impact surfaces between the hammer and anvil on the inside of the tool where the bursts of torque are generated, are forced to absorb high forces and stresses. This causes durability problems, loss of transmission of energy into the joint, and improper operation of the mechanism.

SUMMARY OF THE INVENTION

The durability problem on the curved striking surfaces is overcome by the present invention wherein the curved striking surface of the impact delivering jaw is physically formed with an involute profile as viewed along the axis of rotation of the striking member. The advantage of an involute profile is that forces created upon impact are transmitted within the rotary impact tool in directions that are more easily absorbed by the mechanism. The striking surfaces undergo less destructive force during operation and therefore last longer.

The foregoing and other aspects will become apparent from the following detailed description of the invention when considered in conjunction with the accompanying drawing figures.

BRIEF DESCRIPTION OF THE DRAWINGS

FIGS. 2*a*. through h. show a series of sectional views of the mechanism with a constant radius hammer as used in the Maurer mechanism;

Figure 1:
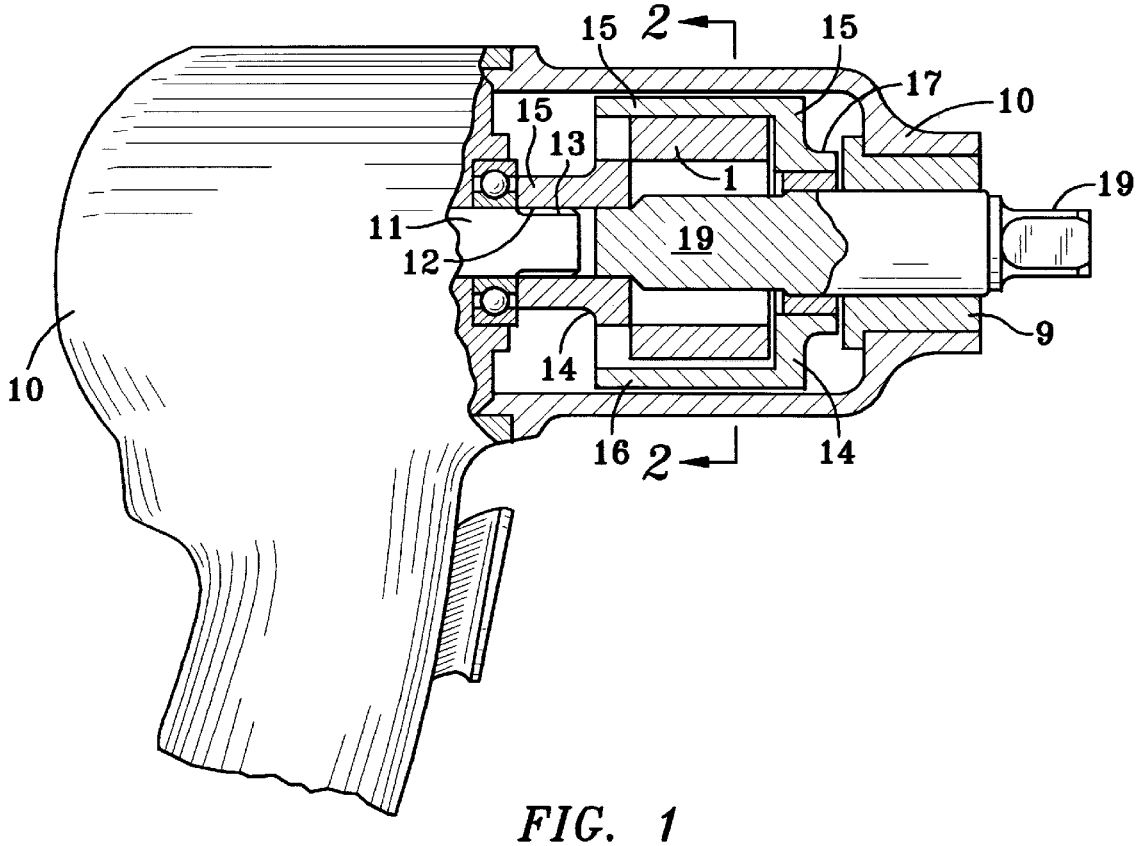
FIG. 1 (PRIOR ART)
FIG. 1 is a side view of an impact tool showing the impact delivering mechanism in longitudinal section.

With reference to the drawings, in particular the rotary impact wrench 1 shown in FIG. 1, reference character 10 identifies the housing for the air driven impact wrench. Air motors used in tools of this type are well known in the art and need not be described in detail.

The output shaft 11 of the air motor is coupled through meshing splines 12, 13 to a hollow cage or carrier member 15 which is journaled by sleeve bearing 17 on the tool power output shaft 19. The motor shaft 11 is coaxially aligned with the power output shaft 19. In contrast, the cage member 15 is coaxially mounted around the output shaft 19, and is mounted for rotating in respect to the output shaft 19. The cage member 15 comprises a pair of longitudinally spaced end plates 14 joined by a pair of diametrically spaced longitudinally extending struts 16 joining together the end plates 14.

Figure 3:
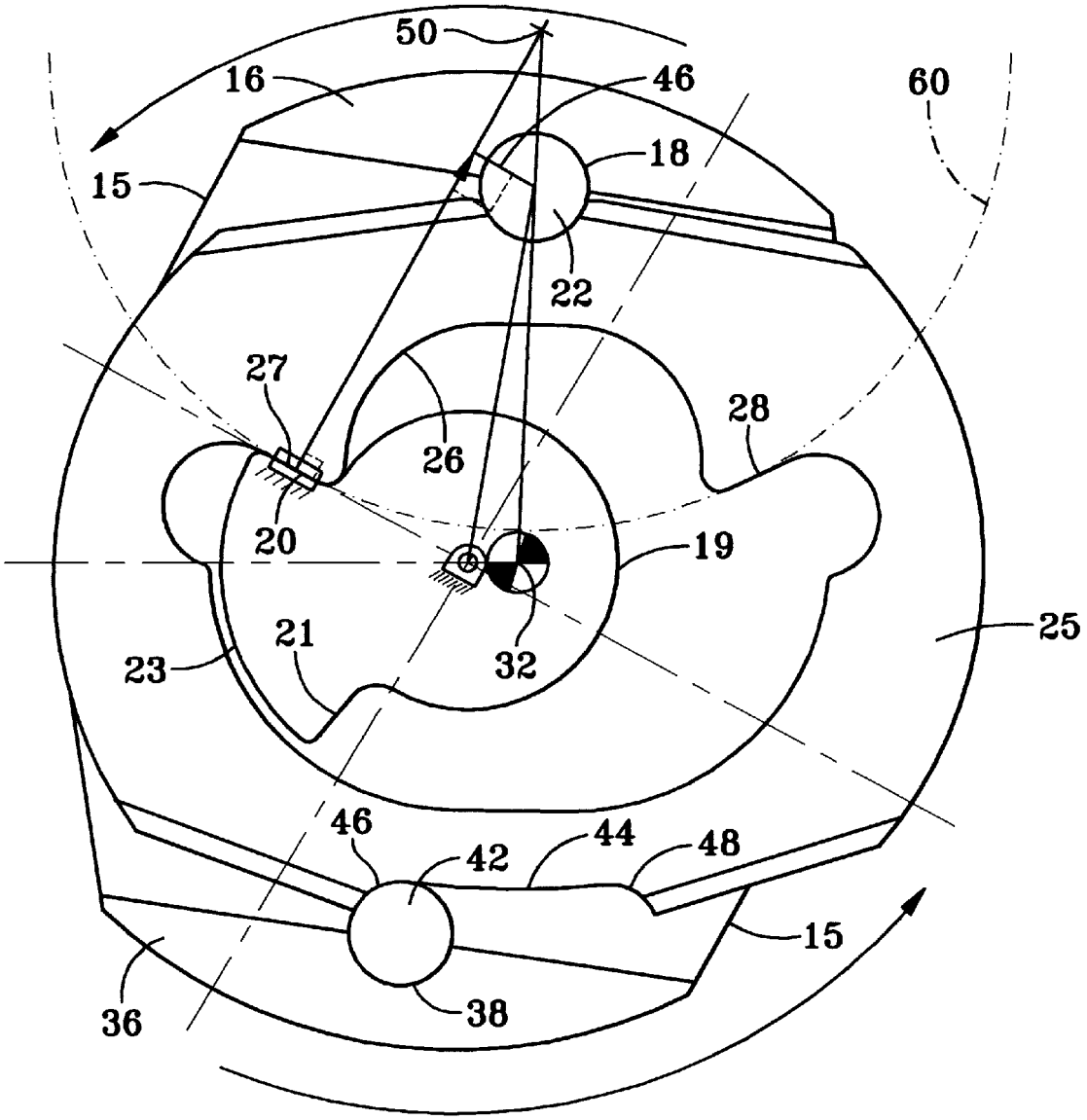
FIG. 3 (PRIOR ART)
FIG. 3 shows a larger view of the mechanism at the initiation of impact for a constant radius hammer.

Referring now to FIG. 3, the rear end portion of the output shaft 19 is integrally formed with an anvil carrying an anvil jaw 23 extending generally radially outwardly therefrom and providing a forward impact receiving surface 20 and a reverse impact receiving surface 21. Referring briefly back to FIG. 1, the forward end of output shaft 19 is carried by bushing 9 mounted in the forward end of tool housing 10.

Referring back to FIG. 3, within the internal diameter of the hollow cage member 15 there is a channel 18 along one of the struts 16 in which is positioned a roller pin or pivot 22, forming, in effect, a swivel connection. The pin 22 is an elongated roller pin about which a portion of a hollow hammer member 25 can partially rotate. The hollow hammer member 25 is mounted around the output shaft 19. Thus the hammer member 25 is pivotally positioned against the cage member 15 about a tilt axis formed by the pin 22 so that it rotates with the cage member under drive from the motor output shaft 11, and additionally can move with an angular pivot motion, relative to the cage member 15, about the tilt axis offset from, but parallel to, the axis of rotation of the cage member.

The cage member 15 has a second strut 36 within which is formed a second channel 38. Within channel 38 is a second roller pin 42. The hollow hammer member 25 has a slot 44 formed on its surface. The slot 44 permits the hollow hammer member 25 to rotate through a finite angle in respect to the strut 16 such that the pin 42 will block hollow hammer member from rotating past the point where slot edges 46 and 48 abut pin 42.

The hollow hammer member 25 has on its internal surface 26 a forward impact jaw or surface 27 and a reverse impact jaw or surface 28 which are movable into and out of the path of the impact receiving surfaces 20, 21 respectively, as the tool operates in the forward or reverse direction. The hammer 25 is shaped in cross-section or symmetrical halves joined along a plane perpendicular to the page and passing through the hammer center-of-gravity 32 and the center of pin 22.

Figure 2A:
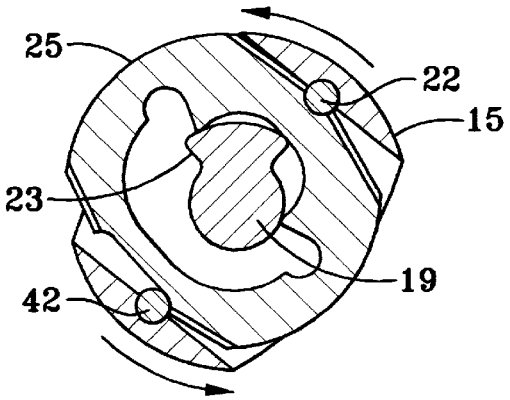
FIG. 2a (PRIOR ART)
FIGS. 2*a*.–h., 3, 4, 5, and 6 are partial sectional views taken along line 2—2 of FIG. 1.

Referring to FIGS. 2*a*. through h., the sequence of figures show a kinematic representation of the operation of the hammer 25, anvil 23, cage 15 and pins 22 and 42, in effect, the Maurer mechanism. This basic rotary impact mechanism and the operation of the rotary impact mechanism is described thoroughly in previously-mentioned U.S. Pat. No. 3,661,217, the Maurer patent, which is incorporated herein by reference.

FIG. 2*a*. shows camming initiation which means the cage 15 is initiating rotation of the hollow hammer member 25 about pin 22. At this point of rotation, the output shaft 19 is not rotating.

Figure 2B:
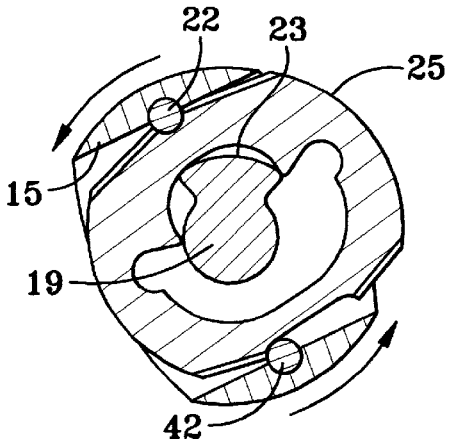
FIG. 2b (PRIOR ART)

In FIG. 2*b*., camming is in process and the hollow hammer member 25 is camming into position in respect to the output shaft 19 for later impact.

Figure 2C:
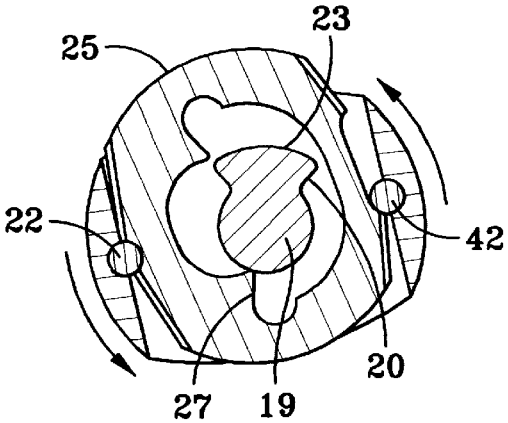
FIG. 2c (PRIOR ART)

In FIG. 2*c*., camming has been completed and the hollow hammer member 25 is properly configured in respect to output shaft 19 to initiate impact properly when the hammer 25 rotates sufficiently such that the forward impact jaw 27 will properly strike the forward impact receiving surface 20 of the anvil jaw 23.

Figure 2D:
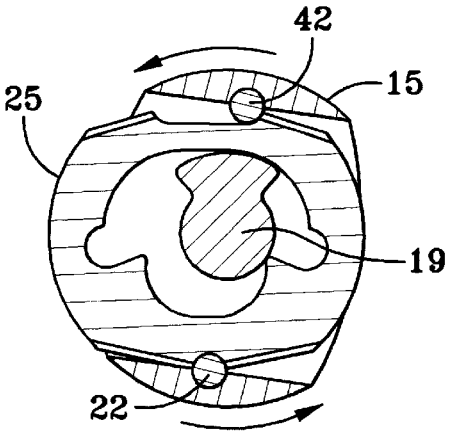
FIG. 2d (PRIOR ART)

In FIG. 2*d*., the hammer member 25 is rotating at the same velocity as the cage 15 meaning the hammer is rotating in free flight.

Figure 2E:
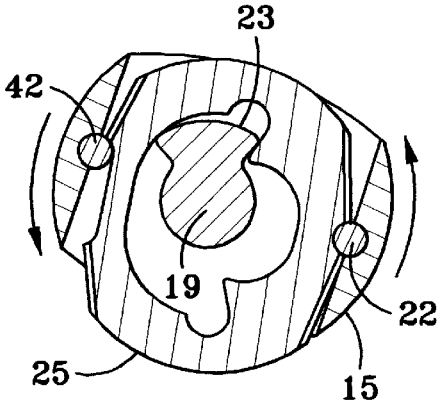
FIG. 2e (PRIOR ART)
Figure 2F:
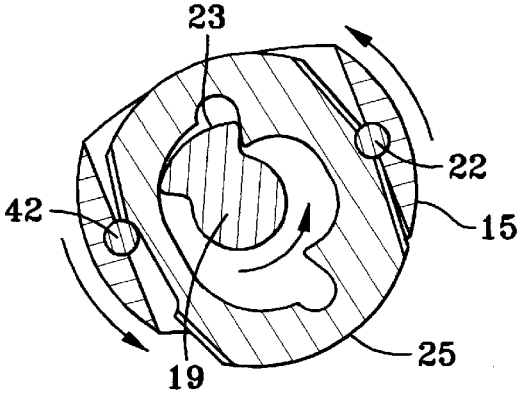
FIG. 2f (PRIOR ART)
Figure 2G:
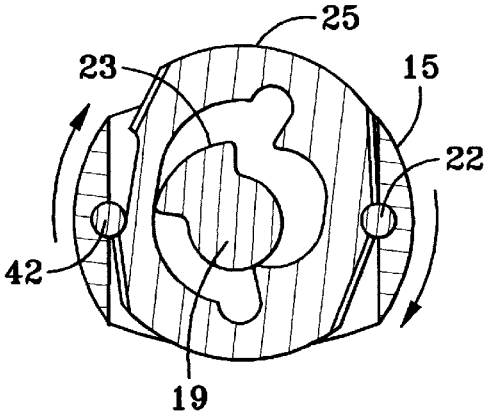
FIG. 2g (PRIOR ART)

In FIG. 2*e*., the hammer 25 has initiated impact with the anvil jaw 23. At this stage of rotation the hammer 25 causes the output shaft 19 to very rapidly accelerate or burst into rotation creating very high torque for a very short time period. The hammer 25 and output shaft 19 rotate together as shown in FIG. 2*f*. at the same speed through the same angle until the cage 15 and hammer 25 rebound as shown in FIG. 2*g*. and rotate briefly in the reverse direction (clockwise in FIG. 2*g*.). During this brief reverse rotation, the hammer 25 is driven off the anvil jaw 23 of the output shaft 19.

Figure 2H:
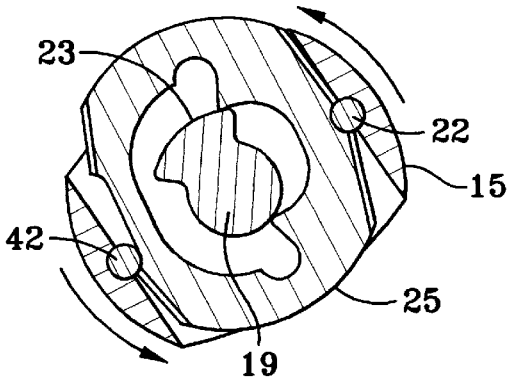
FIG. 2h (PRIOR ART)

In FIG. 2*h*., the air motor (not shown) in the impact wrench has resumed its action of powering rotation of the cage 15 in the counter-clockwise direction. The camming action will shortly resume and the mechanism is ready to go through the same sequence of operations as just described in FIGS. 2*a*.–h.

Figure 4:
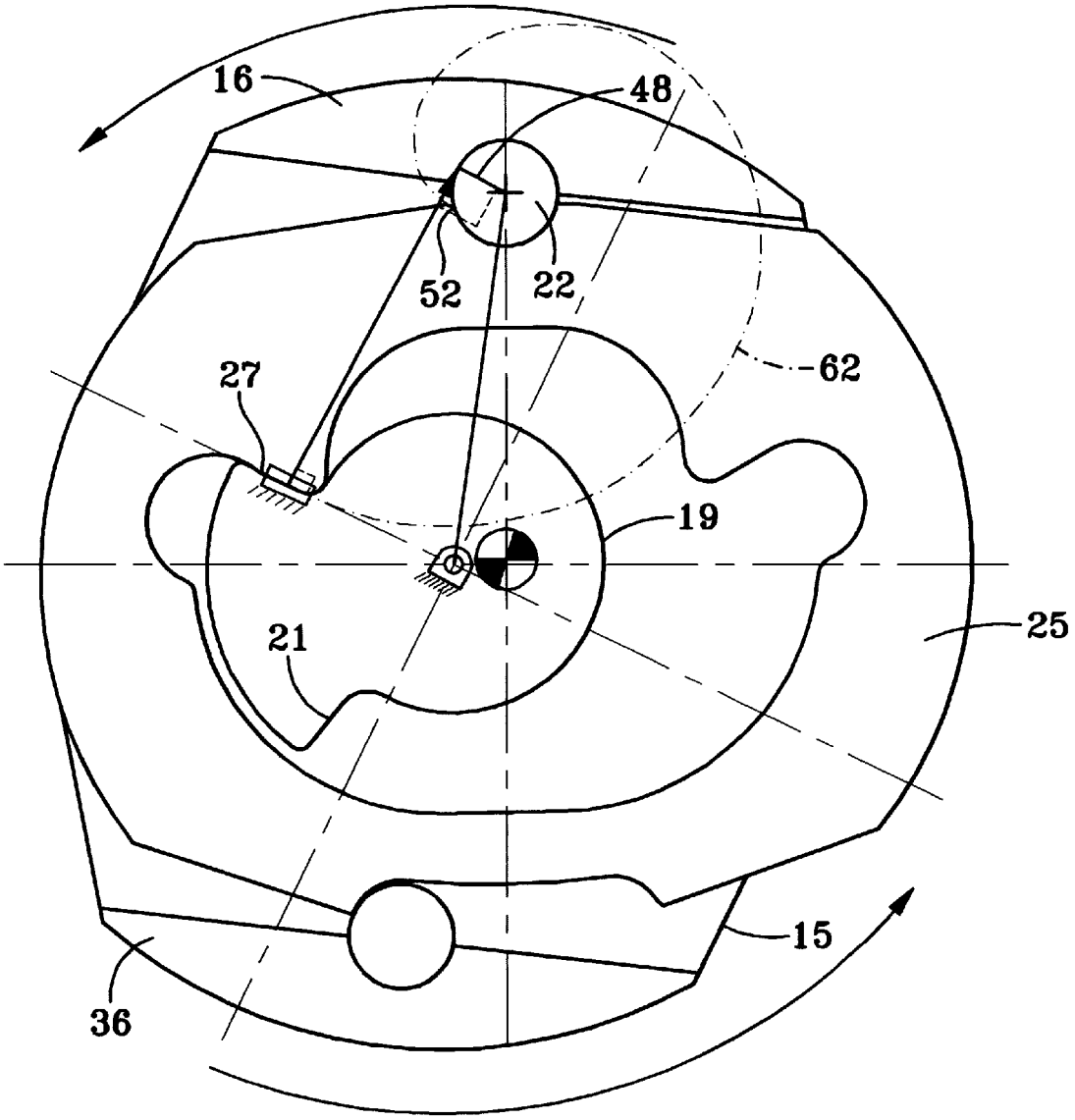
FIG. 4 shows initiation of impact for the mechanism with an involute hammer.

FIGS. 3 and 4 show the impact initiation phase of the mechanism enlarged in respect to FIG. 2*a*. FIG. 3 shows the mechanism and lines of force for a constant radius hammer. FIG. 4 shows the mechanism and lines of force for a hammer with an involute curve profile. Comparison of the linkages show that the mechanism using a constant radius hammer requires that the line of action be directed to the center of the circle from which the constant radius profile is generated. However, the mechanism shown in FIG. 4 using an involute geometry hammer, shows and requires that the line of action be directed tangent to the base circle from which the involute curve profile is generated which is inherent in the geometrical definition of an involute curve. This difference in directed lines of action or force becomes the foundation for the value of this invention. The key differences between the two linkages in FIGS. 3 and 4 involves the length of the moment arms and the origin of generation of impact on the forward impact jaw 27 in each figure. In FIG. 3, the moment arm 46 or $R_R$ for the constant radial jaw profile is approximately 38% longer than the moment arm, 48 or $R_I$, for the involute jaw profile. In FIG. 3, the center of curve generation for the constant radial surface of the forward impact jaw 27 is located at the center of the theoretical circle, point 50 or $O_R$, from which it is derived. The constant radius curve is shown as dashed outline 60. The location of point $O_R$ can be varied over a wide range. The location shown in FIG. 3 is that which is similar to many prior art devices.

Referring now to FIG. 4, the origin of curve generation of the involute profile of the forward impact jaw 27, is at a point 52 or $P_o$ which is shown on the diameter of the base circle of the pin or pivot 22. The involute curve outline is shown as dashed outline 62. Upon initiation of impact, energy transmitted into the joint is somewhat similar in geometry in the mechanisms shown in FIGS. 3 and 4. It is at the time of impending disengagement that the process varies the most because of the differences in geometry.

Figure 5:
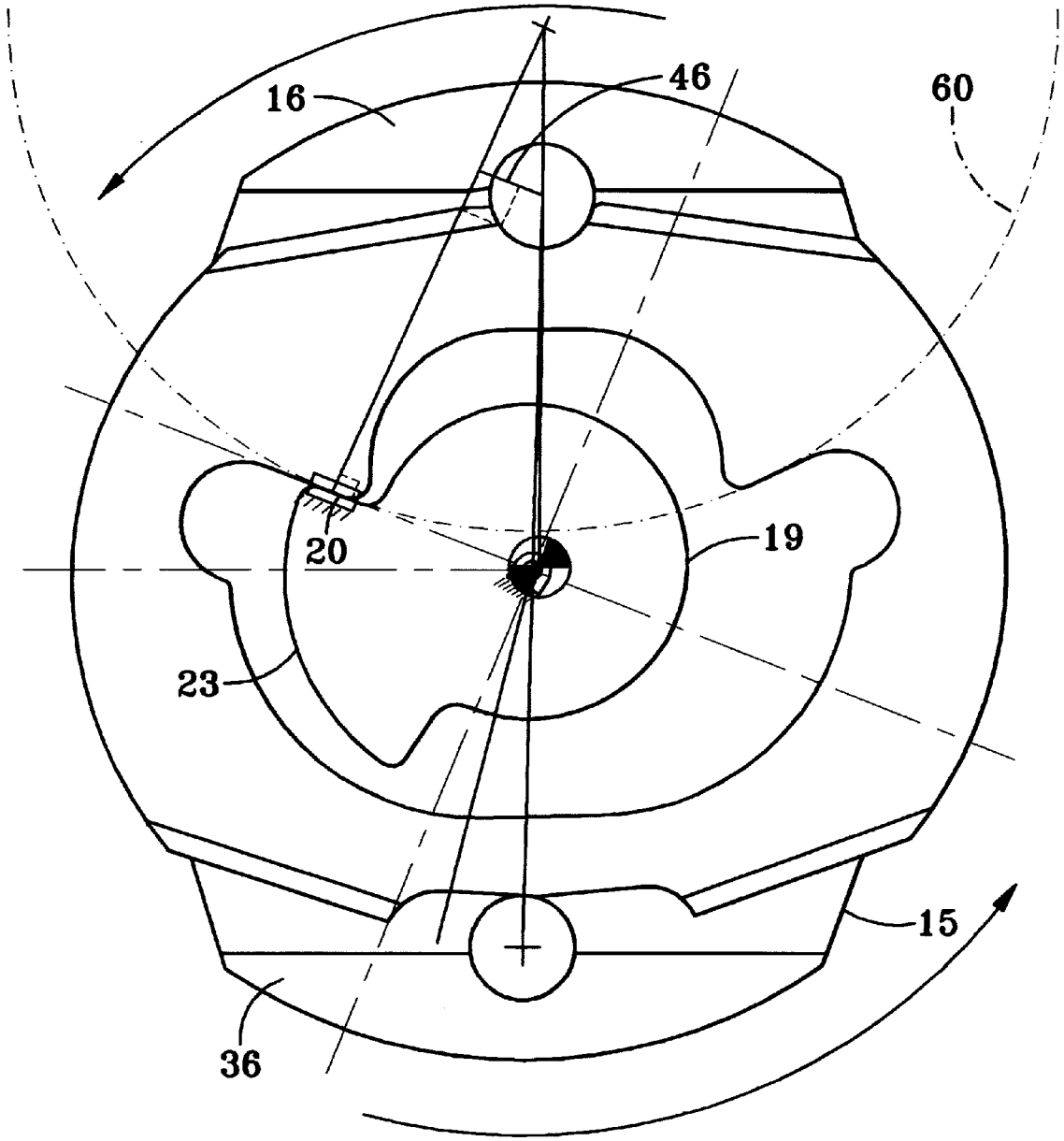
FIG. 5 (PRIOR ART)
FIG. 5 shows the conclusion of impact for the mechanism with a constant radius hammer.
Figure 6:
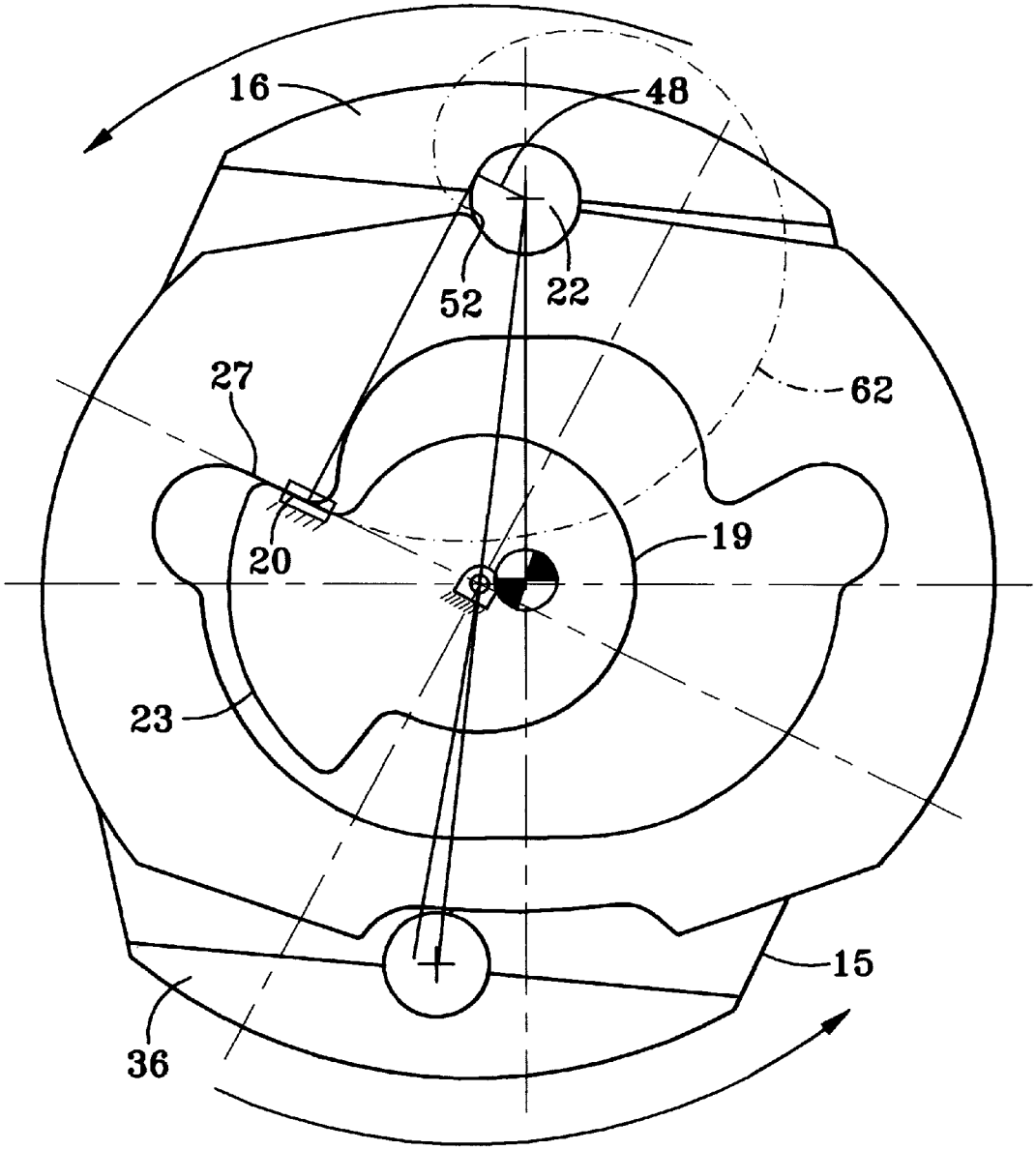
FIG. 6 shows the conclusion of impact for the mechanism with an involute hammer.

Referring now to FIGS. 5 and 6, the configuration of the mechanisms upon impending disengagement is shown with FIG. 5 having a constant radial profile surface on the forward impact jaw 27 and FIG. 6 having an involute curve profile on the surface of the forward impact jaw 27. In FIG. 5 the constant radius outline is shown as dashed line 60. In FIG. 6 the involute profile outline is shown as dashed line 62. Referring now to FIG. 5, as a constant radial surface of the impact jaw 27 progresses toward the outside edge of the anvil jaw 23, the moment arm, 46 or $R_R$, decreases in length. Referring to FIG. 6, the mechanism with an involute surface on the forward impact jaw 27 maintains a moment arm $R_I$ of constant length as is inherent in the definition of the involute curve. Any line of action normal to the curve will also run tangent to the base circle from which it is generated which coincides with the outer radial surface of the pin 22.

From these facts and observations a design approach is derived. This tangency constraint is used to advantage in that appropriate choices of base circle center, base circle radius, and starting position of the "involute generating string" on the base circle lead to a hammer geometry which can: (1) remain locked up during impact to a greater degree than the standard geometry and disengage as easily; or, (2) one that remains equally well locked up during impact but disengages more easily; or (3) one that is positioned to optimize some other property of impact tool performance, as in the current embodiment as shown in FIG. 6. In the current embodiment the choice of involute design results in a more fully locked mechanism during impact. While the current base circle is not large enough to provide for reduced disengagement torque, the impact is taking place on the anvil jaw 23 and forward impact jaw 27 in such a position that once disengagement initiates, the sliding distance traveled by the hammer along the anvil is reduced as shown in the difference between FIGS. 5 and 6. In addition, the force is applied at a location that is farther from the tip of the forward anvil impact jaw 20 as shown in FIG. 6 as opposed to the distance in FIG. 5. Since the force is located farther from the tip, this also promotes greater durability and life of operation. Although both the constant radial and involute surfaces will experience some sliding action along the surface of the forward anvil impact jaw 20 toward its outside edge, the magnitude or distance within which this is accomplished is significantly longer for the constant radial surface as shown in FIG. 5. The shorter length of sliding along with the location of impact for the involute profile shown in FIG. 6 promotes reduced wear on the forward impact jaw surface 27.

In alternate embodiments it is known that the location of the base circle for generating the involute curve could be varied to other locations with different radii for the base circle. As mentioned previously, this will provide a variety of benefits depending on the selection of the location and size of the base circle.

Having described the invention in terms of a preferred embodiment, we do not wish to be limited in the scope of the invention except as claimed.

What is claimed is:

1. An improved rotary impact tool comprising, in combination, a housing, a motor mounted in said housing, an output shaft mounted on said housing for rotation and including an impact receiving anvil jaw generally radially disposed on a periphery thereof, a carrier member coaxially around said output shaft and mounted for rotation in respect to said output shaft, driving connection means between said motor and said carrier member for rotating said carrier member, a hammer member pivotally connected in said carrier member for rotation therewith and for angular pivotal motion relative thereto about an axis offset from but parallel to an axis of rotation of said carrier member, said hammer member for clockwise impact operation having a clockwise impact delivering jaw on an inside surface, said impact jaw being movable into and out of the path of said impact receiving anvil jaw to deliver an impact blow thereto, cam means for effecting the angular pivot movement of said impact delivering jaw into the path of said anvil jaw in a clockwise direction relative to said carrier member, centrifugal force created by the proportions, mass and mass center location of said hammer member holding said impact delivering jaw in the path of said anvil jaw until the delivery of said impact blow thereto, and automatic means for effecting the angular pivot movement of said impact jaw out of the path of said anvil jaw in a counter clockwise direction in relation to said carrier member after the delivery of said impact blow, the improvement comprising a curved striking surface formed on said input delivering jaw, said curved surface having an involute profile as viewed along the axis of rotation of said carrier member.

2. The rotary impact tool as set forth in claim 1 wherein said hammer member is pivotally connected by a pivot pin mounted between carrier member and said hammer member and said involute profile is generated from a base circle having the same location and outer circumference as said pivot pin.

3. The rotary impact tool as set forth in claim 2 wherein said base circle radius is between ½ and 1/10 of a distance between the point of involute curve generation and said involute curve during impact between said carrier member and said hammer member.

4. The rotary impact tool as set forth in claim 1 wherein the point of impact between said carrier member and said hammer member is located on said involute curve during operation of said rotary impact tool.

5. A rotary impact tool having an internal mechanism for creating short duration rotary impacts wherein the mechanism comprises, in combination, a housing, a motor, an output shaft, an impact receiving anvil jaw generally disposed on a periphery of said output shaft, a hammer member for delivering rotational force to said anvil jaw, said hammer member having an impact delivering impact jaw for interacting with said anvil jaw to deliver said rotational force wherein said impact delivering jaw has a curved striking surface with an involute profile as viewed along an axis of rotation of said output shaft.

* * * * *